US006179571B1

(12) United States Patent
Kawachi et al.

(10) Patent No.: US 6,179,571 B1
(45) Date of Patent: Jan. 30, 2001

(54) SWASH PLATE TYPE COMPRESSOR

(75) Inventors: Masaki Kawachi; Toshikatsu Miyaji, both of Tochigi (JP)

(73) Assignee: Calsonic Kansei Corporation, Tokyo (JP)

( * ) Notice: Under 35 U.S.C. 154(b), the term of this patent shall be extended for 0 days.

(21) Appl. No.: 09/175,420

(22) Filed: Oct. 20, 1998

(30) Foreign Application Priority Data

Oct. 21, 1997 (JP) ..... 9-288766

(51) Int. Cl.[7] ..... F04B 1/26; F01B 13/04
(52) U.S. Cl. ..... 417/222.1; 417/269; 92/12.2
(58) Field of Search ..... 417/222.1, 222.2, 417/269; 92/12.2, 138

(56) References Cited

U.S. PATENT DOCUMENTS

| | | | | |
|---|---|---|---|---|
| 4,674,957 | * | 6/1987 | Ohta et al. | 417/222.2 |
| 4,712,982 | * | 12/1987 | Inagaki et al. | 417/222.1 |
| 5,105,728 | * | 4/1992 | Hayase et al. | 92/71 |
| 5,181,453 | * | 1/1993 | Kayukawa et al. | 92/12.2 |
| 5,706,716 | | 1/1998 | Umemura | 92/165 |
| 5,749,712 | | 5/1998 | Umemura | 417/269 |

FOREIGN PATENT DOCUMENTS

| | | |
|---|---|---|
| 5-195949 | 8/1993 | (JP) . |
| 6-101640 | 4/1994 | (JP) . |
| 7-103138 | 4/1995 | (JP) . |
| 8-61231 | 3/1996 | (JP) . |

* cited by examiner

*Primary Examiner*—Noah P. Kamen
*Assistant Examiner*—Mahmoud M Gimie
(74) *Attorney, Agent, or Firm*—Foley & Lardner

(57) ABSTRACT

A swash plate type compressor comprises a case; a drive shaft rotatably installed in the case; a drive plate fixed to the drive shaft to rotate therewith; a sleeve axially slidably disposed on the drive shaft; a journal pivotally mounted on the sleeve; a swash plate disposed on the journal to move therewith; and a transmission/hinge mechanism arranged between the drive plate and the journal to transmit the rotation of the drive shaft to the journal permitting the pivotal movement of the journal relative to said sleeve. The transmission/hinge mechanism includes a first arm projected from the drive plate and having an elongate through hole; two spaced second arms projected from the journal, the second arms being so spaced as to intimately put therebetween the first arm, the second arms having cylindrical bores which are aligned; and a pin including a middle portion slidably received in the elongate through hole and axially opposed end portions press-fitted in the cylindrical bores of the second arms. The press-fitting of the pin with the cylindrical bore of a leading one of the second arms is stronger in strength than that with the cylindrical bore of a trailing one of the second arms.

16 Claims, 3 Drawing Sheets

SWASH PLATE TYPE COMPRESSOR

BACKGROUND OF THE INVENTION

1. Field of the Invention

The present invention relates in general to compressors for use in a refrigerating cycle of an automotive air conditioning system, and more particularly to compressors of a swash plate type.

2. Description of the Prior Art

In order to clarify the task of the present invention, one conventional compressor of the above-mentioned type will be outlined, which is described in Japanese Patent First Provisional Publication 7-103138.

The compressor comprises a case having a crank chamber is therein, a drive shaft rotatably installed in the case, a drive plate fixed to the drive shaft to rotate therewith, a sleeve axially slidably disposed on the drive shaft, a journal pivotally mounted on the sleeve, a swash plate tightly disposed on the journal, a transmission/hinge mechanism arranged between the drive plate and the journal for transmitting the rotation of the drive shaft to the journal while permitting a pivotal movement of the journal relative to the sleeve, a plurality of cylinders defined in the case, and a plurality of pistons driven by the swash plate to be reciprocatively moved in the cylinders. To a back side of the case, there is mounted through a valve plate a rear housing which has refrigerant intake and exhaust chambers formed therein.

The transmission/hinge mechanism comprises a first arm projected from the drive plate, a second arm projected from the journal, an elongate opening formed in the first arm and a pin held by the second arm and slidably engaged with the elongate opening. When, due to rotation of the drive shaft, the drive plate is rotated therewith, the rotation of the drive plate is transmitted to the journal through the pivotally engaged first and second arms while permitting the pivotal movement of the journal on the sleeve. During this, due to an inherent construction of the transmission/hinge mechanism, leading portions (which are termed in view of the direction in which the drive plate rotates under normal operation of the compressor) of the pivotally engaged first and second arms are applied with a marked stress as compared with trailing portions of the same. That is, under operation of the compressor, the maximum compression load of the pistons is applied to the leading portions through the swash plate. This phenomenon tends to cause a poor rotation transmission from the drive plate to the journal as well as a poor pivoting movement of the journal relative to the sleeve.

Hitherto, many attempts have been made for eliminating the above-mentioned drawbacks. However, almost all the attempts have failed to exhibit satisfied results.

SUMMARY OF THE INVENTION

It is therefore an object of the present invention to provide a swash plate type compressor which is free of the above-mentioned drawbacks.

It is another object of the present invention to provide a swash plate type compressor wherein a leading portion of the transmission/hinge mechanism is reinforced by a simple structure.

It is still another object of the present invention to provide a swash plate type compressor wherein a rotation unit including a drive shaft, a drive plate, a journal and a swash plate can smoothly and precisely rotate about the axis of drive shaft.

According to the present invention, there is provided a swash plate type compressor which comprises a case; a drive shaft installed in the case and rotatable about its axis; a drive plate fixed to the drive shaft to rotate therewith; a sleeve axially slidably disposed on the drive shaft; a journal pivotally mounted on the sleeve; a swash plate disposed on the journal to move therewith; and a transmission/hinge mechanism arranged between the drive plate and the journal to transmit the rotation of the drive shaft to the journal permitting the pivotal movement of the journal relative to the sleeve, wherein the transmission/hinge mechanism includes a first arm possessed by one of the drive plate and the journal, the first arm having an elongate through hole; two spaced second arms possessed by the other of the drive plate and the journal, the second arms being so spaced as to intimately put therebetween the first arm, the second arms having cylindrical bores which are aligned; and a pin including a middle portion slidably received in the elongate through hole and axially opposed end portions press-fitted in the cylindrical bores of the second arms, the press-fitting of the pin with the cylindrical bore of a leading one of the second arms being stronger in strength than that with the cylindrical bore of a trailing one of the second arms.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
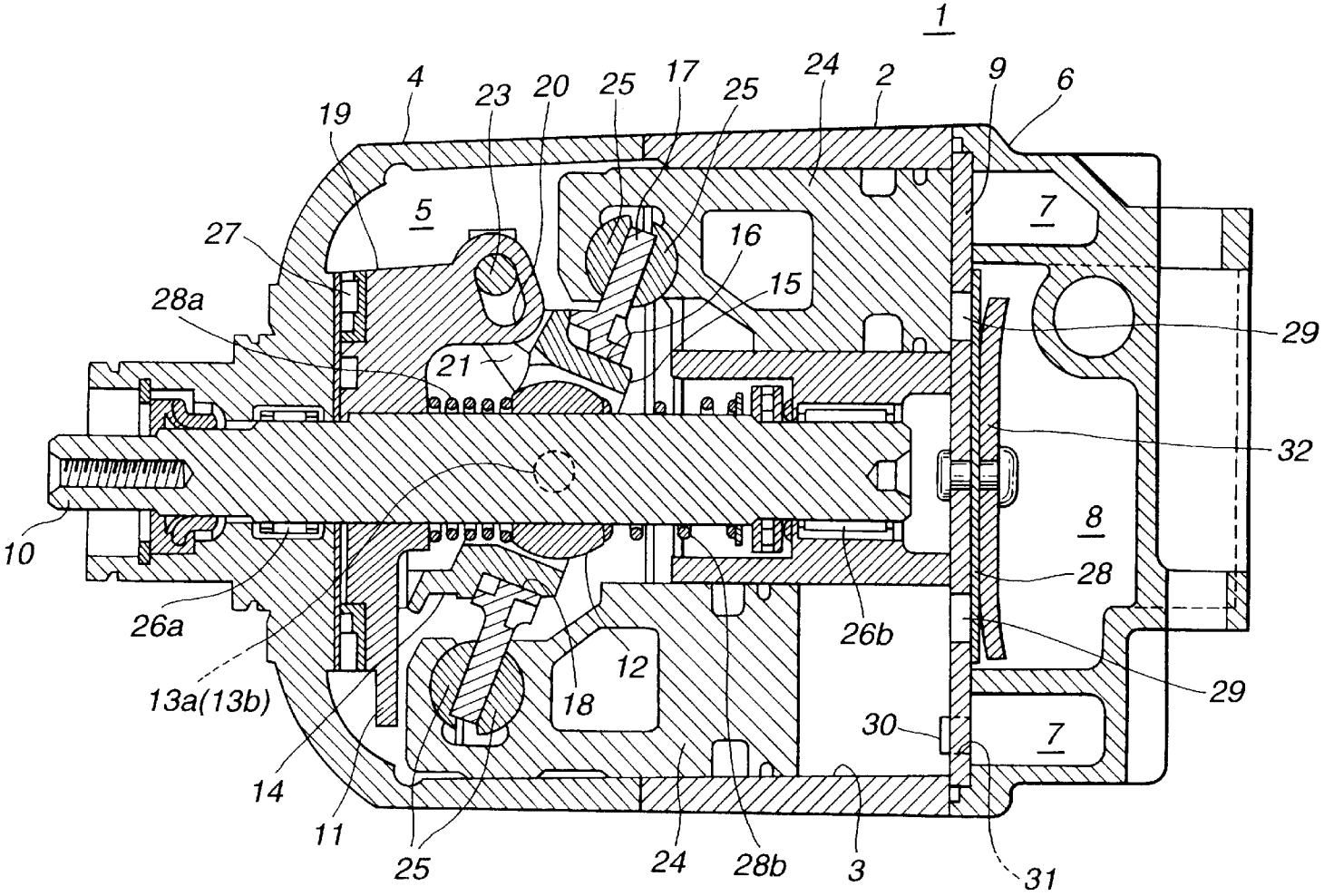
FIG. 1 is a sectional view of a variable displacement swash plate type compressor to which the present invention is practically applied.
Figure 2:
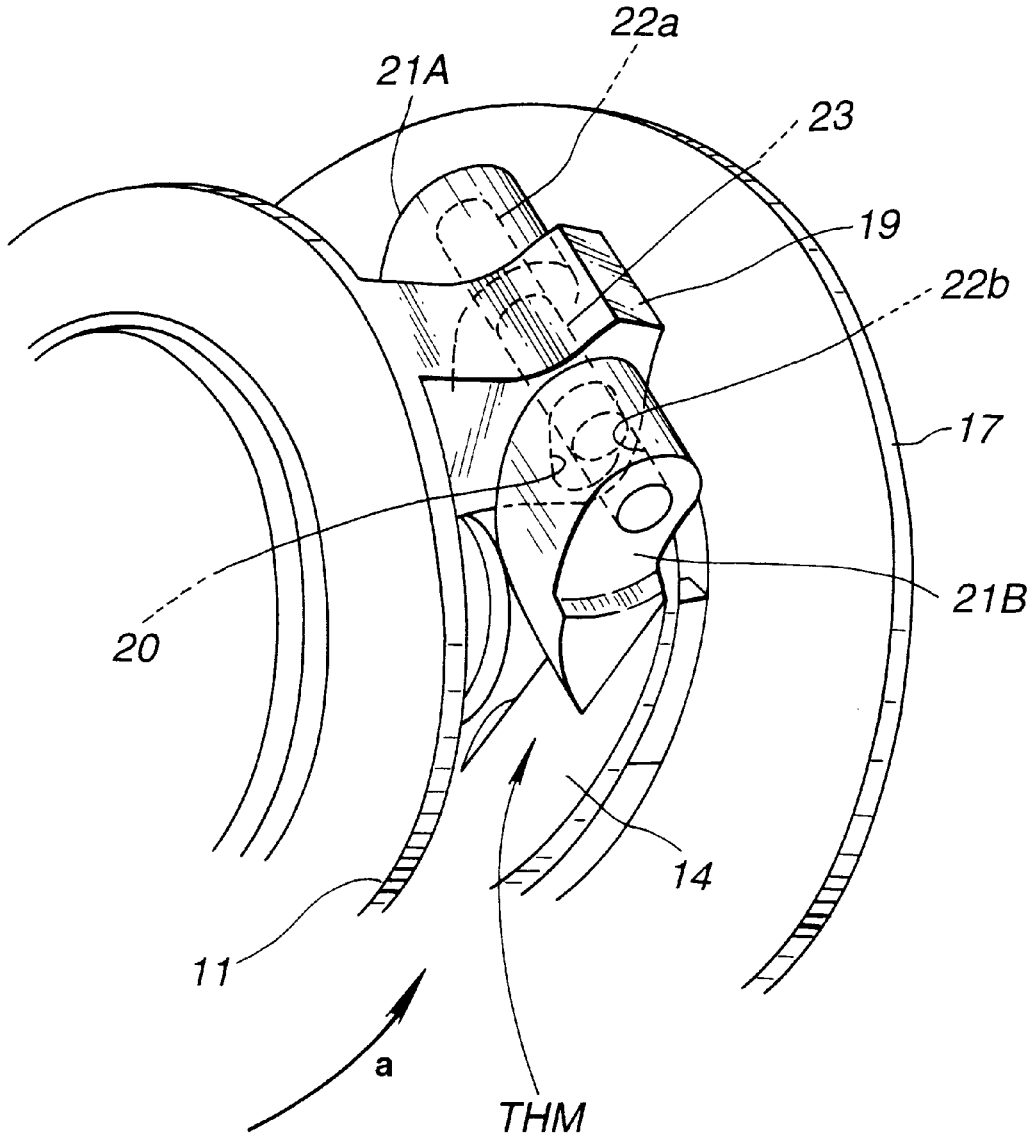
FIG. 2 is a perspective but partial view of a transmission/hinge mechanism employed in the compressor of the present invention.
Figure 3:
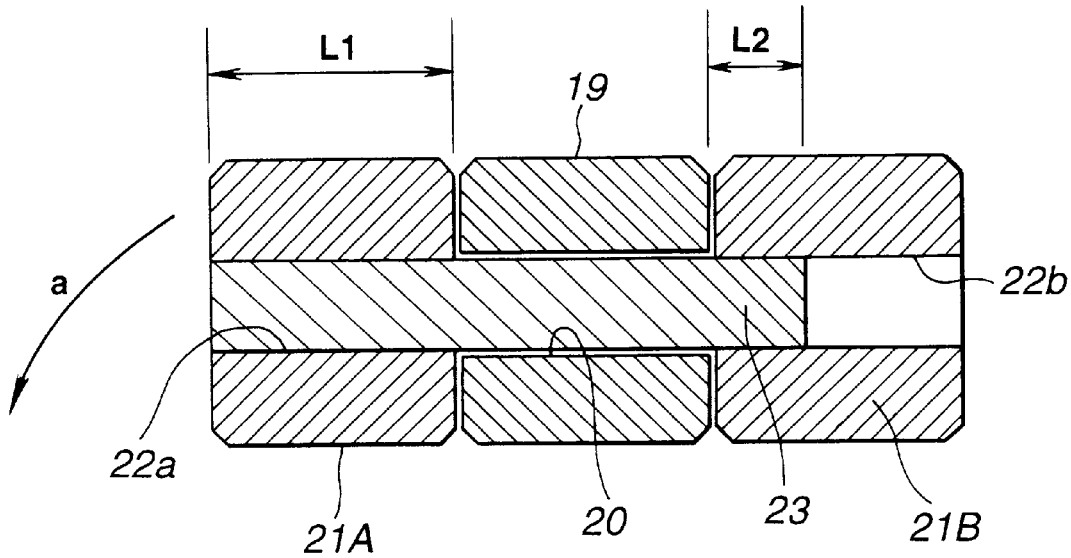
FIG. 3 is a sectional view of the transmission/hinge mechanism.

Referring to FIGS. 1 to 3, particularly FIG. 1, there is shown a variable displacement swash plate type compressor 1 to which the present invention is practically applied.

As is shown in FIG. 1, the compressor 1 comprises a cylinder block 2 having a plurality of cylinders 3 circularly arranged therein, a front housing 4 connected to a front end of the cylinder block 2 to define therein a crank chamber 5, and a rear housing 6 connected to a rear end of the cylinder block 2 to define therein refrigerant intake and exhaust chambers 7 and 8. A valve plate 9 is interposed between the cylinder block 2 and the rear housing 6.

In the crank chamber 5, there extends axially a drive shaft 10 to which a drive plate 11 is fixed to rotate therewith. Behind the drive plate 11, there is located a sleeve 12 which is axially movably disposed on the drive shaft 11. First and second biasing springs 28*a* and 28*b* are disposed on the drive shaft 11, between which the sleeve 12 is interposed and balanced. A journal 14 is pivotally mounted to the sleeve 12 through aligned pins 13*a* and 13*b*. A circular swash plate 17 is concentrically mounted on the journal 14 to move therewith. For this mounting, the swash plate 17 has its threaded cylindrical inner wall 18 engaged with a threaded cylindrical outer wall 16 of a boss portion 15 of the journal 14. That is, a so-called screw-nut connection is provided between the swash plate 17 and the journal 14.

Between the drive plate 11 and the journal 14, there is arranged an improved transmission/hinge mechanism "THM" for transmitting rotation of the drive plate to the journal while permitting a pivotal movement of the journal 14 relative to the sleeve 12. The detail of this transmission/hinge mechanism "THM" will be described in detail hereinafter.

The cylinders 3 in the cylinder block 2 have respective pistons 24 slidably received therein. Each piston 24 has an exposed neck portion which slidably holds a peripheral portion of the swash plate 17 through a pair of shoes 25. That is, the shoes 25 are pivotally held by the neck portion while slidably putting therebetween the peripheral portion of the swash plate 17.

The inclination angle of the swash plate 17 is determined by a pressure in the crank chamber 5, which is controlled by a pressure control valve (not shown) in accordance with a pressure in the refrigerant intake chamber 7. The detail of the pressure control valve is described in, for example, U.S Pat. No. 5,749,712 granted to Yukio UMEMURA on May 12, 1998. In accordance with the inclination angle of the swash plate 17, the stroke of each piston 24 is varied thereby changing the displacement of the compressor 1.

Denoted by numerals 26*a* and 26*b* are front and rear bearings for the drive shaft 10, and denoted by a numeral 27 is a thrust bearing arranged between the front housing 4 and the drive plate 11. Denoted by numerals 28 are reed valves for opening and closing outlet openings 29 formed in the valve plate 9, denoted by numerals 30 are reed valves for opening and closing inlet openings 31 formed in the valve plate 9, and denoted by numeral 32 is a retainer for retaining open degree of the reed valves 28.

When, in operation, the drive shaft 10 is rotated by, for example, an engine of an associated motor vehicle, the drive plate 11 is rotated about an axis of the drive shaft 10. Due to work of the transmission/hinge mechanism "THM", the rotation of the drive plate 11 is transmitted to the journal 14 thereby to rotate the swash plate 17. Due to rotation of the swash plate 17 which is kept inclined relative to the drive shaft 10, the pistons 24 are forced to reciprocate in the associated cylinders 3 thereby to compress a refrigerant fed to the cylinders 3. When the inclination angle of the swash plate 17 is changed due to the above-mentioned reason, the stroke of the pistons 24 is changed and thus the displacement of the compressor 1 is changed.

The detail of the transmission/hinge mechanism "THM" will be described in the following with reference to FIG. 2.

As shown, the mechanism "THM" comprises a first arm 19 projected rearward from the drive plate 11, two spaced second arms 21A and 21B projected forward from the journal 14 and a pin 23 pivotally connecting the first and second arms 19, 21A and 21B. The first arm 19 has parallel flat walls at lateral sides. The first arm 19 is formed with a through hole 20 which extends between the two parallel flat walls in a direction perpendicular to an axis of the drive plate 11 (viz., the axis of the drive shaft 10). As shown, the through hole 20 has an elliptical cross section therethroughout.

The two second arms 21A and 21B are the same in thickness and are so spaced as to intimately put therebetween the first arm 19. For achieving the intimate contact with the parallel flat walls of the first arm 19, respective inside walls of the two second arms 21A and 21B constitute parallel flat surfaces. The second arms 21A and 21B are respectively formed with cylindrical bores 22*a* and 22*b* which are aligned. As shown, upon assembly, the pin 23 is slidably received in the elongate through hole 20 having axially opposed end portions thereof press-fitted in the cylindrical bores 22*a* and 22*b*. With this, the journal 14 is permitted to pivot relative to the sleeve 12 by an angle corresponding to a distance by which the pin 23 moves in the elongate through hole 20.

The transmission/hinge mechanism "THM" has further the following constructional feature.

As is seen from FIGS. 2 and 3, the press-fitted engagement of the pin 23 with the leading one 21A of the spaced second arms 21A and 21B is much stronger or deeper than that with the trailing one 21B of the spaced second arms. The terms "leading" and "trailing" are to be understood with respect to a direction "a" in which the drive shaft 10 (and thus, the swash plate 17) rotates under normal operation of the compressor 1.

That is, as is seen from FIG. 3, a left part of the pin 23 is engaged fully with the bore 22*a* of the leading second arm 21A, while, a right part of the pin 23 is engaged half with the bore 22*b* of the trailing second arm 21B. More specifically, the engagement of the left part of the pin 23 with the leading second arm 21A is made by the length "L1", and the engagement of the right part of the pin 23 with the trailing second arm 21B is made by the length of "L2" which is smaller than the length "Li".

In the following, advantages possessed by the transmission/hinge mechanism "THM" will be described.

First, due to the full engagement of the pin 23 with the bore 22*a*, the mechanical strength of the leading second arm 21A is increased to a certain degree. This is very important and desirable since under operation of the compressor 1 a marked stress is applied to the leading second arm 21A. Actually, the leading second arm 21A has to bear the maximum compression load of the pistons 24. While, a load applied to the trailing second arm 21B is not so strong as the load applied to leading second arm 21A.

Second, due to the half engagement of the pin 23 with the bore 22*b*, the mass of the transmission/hinge mechanism "THM" is reduced. With this, a rotation unit including the drive shaft 10, the drive plate 11, the journal 14 and the swash plate 17 can smoothly and precisely rotate about the axis of the drive shaft 10. This avoids rotation noises and prolongs the lives of the bearings 26*a*, 26*b* and 27.

Figure 4:
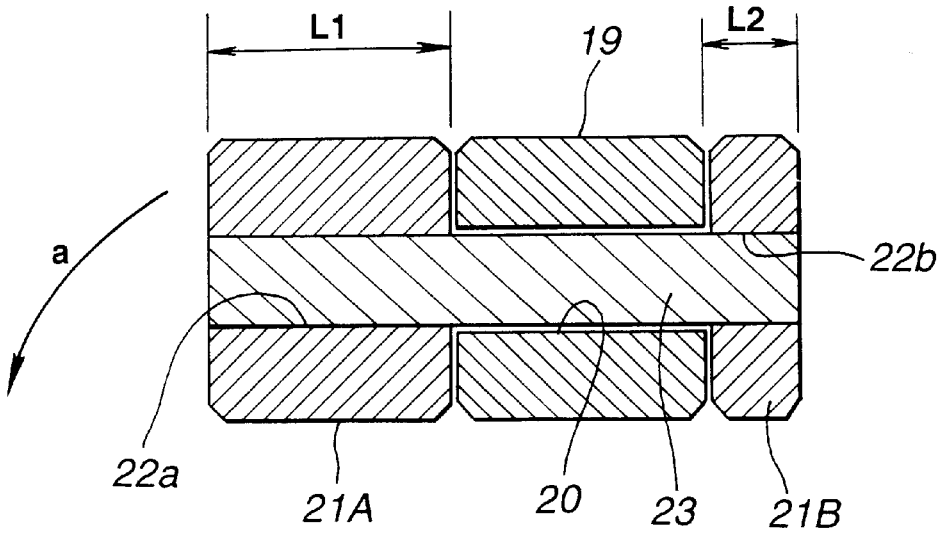
FIG. 4 is a view similar to FIG. 3, but showing a modification of the transmission/hinge mechanism.

Referring to FIG. 4, there is shown a modification of the transmission/hinge mechanism "THM".

In this modification, the thickness of the trailing second arm 21B is reduced to the length "L2". Due to this measure, the above-mentioned second advantage is much promoted. Actually, the mass of the transmission/hinge mechanism "THM" is reduced, which much assures the smooth and precise rotation of the rotation unit about the axis of the drive shaft 10.

Although the above-description is directed to the transmission/hinge mechanism wherein the first arm 19 is possessed by the drive plate 11 and the second arms 21A and 21B are possessed by the journal 14, the mechanism may have such a construction that the first arm 19 is possessed by the journal 14 and the second arms 21A and 21B are possessed by the drive plate 11.

Although the above description is directed to the compressor of a variable displacement type, the concept of the present invention can be applied to swash plate type compressors which are not of the variable displacement type.

It is to be understood that, although the invention has been described with specific reference to a particular embodiment thereof, it is not to be so limited since changes and alternations therein may be made within the full intended scope of this invention as defined by the appended claims.

What is claimed is:

1. A swash plate type compressor comprising:

a case;

a drive shaft installed in said case and rotatable about its axis;

a drive plate fixed to said drive shaft to rotate therewith;

a sleeve axially slidably disposed on said drive shaft;

a journal pivotally mounted on said sleeve;

a swash plate disposed on said journal to move therewith; and a transmission/hinge mechanism arranged between said drive plate and said journal to transmit the rotation of said drive shaft to said journal permitting the pivotal movement of said journal relative to said sleeve, wherein said transmission/hinge mechanism includes:

a first arm connected to one of said drive plate and said journal, said first arm having an elongate through hole;

two spaced second arms connected to the other of said drive plate and said journal and acting as leading and trailing arms when the selected one of said drive plate and said journal rotates in a normal direction, said second arms being so spaced as to closely accommodate therebetween said first arm, said second arms having cylindrical bores which are aligned; and a pin including a middle portion slidably received in said elongate through hole and axially opposed end portions press-fitted in the cylindrical bores of said second arms, the press-fitting of the pin with the cylindrical bore of the leading one of said second arms being substantially stronger in connecting strength than that with the cylindrical bore of the trailing one of said second arms.

2. A swash plate type compressor as claimed in claim 1, in which said two second arms are the same in thickness.

3. A swash plate type compressor as claimed in claim 2, in which one axial end portion of said pin is fully engaged with the cylindrical bore of the leading one of the second arms and in which the other axial end portion of said pin is half engaged with the cylindrical bore of the trailing one of the second arms.

4. A swash plate type compressor as claimed in claim 1, in which the thickness of the trailing one of the second arms is smaller than that of the leading one, and in which the end portions of the pin are fully engaged with the cylindrical bores of the two second arms.

5. A swash plate type compressor as claimed in claim 1, in which said first arm is possessed by said drive plate and said two second arms are possessed by said journal.

6. A swash plate type compressor as claimed in claim 5, in which said first arm has at lateral sides parallel flat walls and in which respective inside walls of said two second arms constitute parallel flat surfaces with which said parallel flat walls of said first arm slidably contact.

7. A swash plate type compressor as claimed in claim 6, in which said elongate through hole extends between the parallel flat walls in a direction perpendicular to an axis of said drive plate.

8. A swash plate type compressor as claimed in claim 1, further comprising:

a plurality of cylinders circularly arranged in said case; and a plurality of pistons driven by said swash plate to be reciprocatively moved in said cylinders.

9. A swash plate type compressor comprising:

a case;

a drive shaft installed in said case and rotatable about its axis;

a drive plate fixed to said drive shaft to rotate therewith;

a sleeve axially slidably disposed on said drive shaft;

a journal pivotally mounted on said sleeve;

a swash plate disposed on said journal to move therewith; and a transmission/hinge mechanism arranged between said drive plate and said journal to transmit the rotation of said drive shaft to said journal permitting the pivotal movement of said journal relative to said sleeve, wherein said transmission/hinge mechanism includes:

a first arm connected to one of said drive plate and said journal, said first arm having an elongate through hole;

two spaced second arms connected to the other of said drive plate and said journal and acting as leading and trailing arms when the selected one of said drive plate and said journal rotates in a normal direction, said second arms being so spaced as to closely accommodate therebetween said first arm, said second arms having cylindrical bores which are aligned; and a pin including a middle portion slidably received in said elongate through hole and axially opposed end portions press-fitted in the cylindrical bores of said second arms, the mass of the end portion in the bore of the leading arm being substantially greater than the mass of the end portion in the bore of the trailing arm.

10. A swash plate type compressor as claimed in claim 9, in which said two second arms are the same in thickness.

11. A swash plate type compressor as claimed in claim 9, in which one axial end portion of said pin is fully engaged with the cylindrical bore of the leading one of the second arms and in which the other axial end portion of said pin is half engaged with the cylindrical bore of the trailing one of the second arms.

12. A swash plate type compressor as claimed in claim 9, in which the thickness of the trailing one of the second arms is smaller than that of the leading one, and in which the end portions of the pin are fully engaged with the cylindrical bores of the two second arms.

13. A swash plate type compressor as claimed in claim 12, in which said first arm is possessed by said drive plate and said two second arms are possessed by said journal.

14. A swash plate type compressor as claimed in claim 13, in which said first arm has at lateral sides paralled flat walls and in which respective inside walls of said two second arms constitute parallel flat surfaces with which said parallel flat walls of said first arm slidably contact.

15. A swash plate type compressor as claimed in claim 14, in which said elongate through hole extends between the parallel flat walls in a direction perpendicular to an axis of said drive plate.

16. A swash plate type compressor as claimed in claim 9, further comprising:

a plurality of cylinders circularly arranged in said case; and a plurality of pistons driven by said swash plate to be reciprocatively moved in said cylinders.

* * * * *